United States Patent [19]

Cline et al.

[11] 4,363,599

[45] Dec. 14, 1982

[54] CLEARANCE CONTROL

[75] Inventors: Larry D. Cline, Fairfield; Ambrose A. Hauser, Wyoming; James E. Sidenstick, Cincinnati; Mark S. Zlatic, West Chester, all of Ohio

[73] Assignee: General Electric Company, Cincinnati, Ohio

[21] Appl. No.: 89,790

[22] Filed: Oct. 31, 1979

[51] Int. Cl.[3] ..... F01D 25/26

[52] U.S. Cl. ..... 415/136; 415/171; 415/174; 415/178

[58] Field of Search ..... 415/134, 136, 138, 115, 415/116, 180, 178, 174, 171, 170 R

[56] References Cited

U.S. PATENT DOCUMENTS

| | | | |
|---|---|---|---|
| 3,986,720 | 10/1976 | Knudsen et al. | 415/136 |
| 4,023,919 | 5/1977 | Patterson | 415/178 |
| 4,222,707 | 9/1980 | Drouet et al. | 415/178 |
| 4,242,042 | 12/1980 | Schwarz | 415/116 |

FOREIGN PATENT DOCUMENTS

| | | |
|---|---|---|
| 597953 | 2/1948 | United Kingdom . |
| 1230324 | 4/1971 | United Kingdom . |
| 1561115 | 2/1980 | United Kingdom . |
| 2035466 | 6/1980 | United Kingdom . |

*Primary Examiner*—Robert E. Garrett

*Attorney, Agent, or Firm*—Donald W. Walk; Carl L. Silverman; Derek P. Lawrence

[57] ABSTRACT

A system is provided inside a turbomachine for controlling operational clearance between a turbine rotor and a surrounding turbine shroud. The system comprises a plurality of control rings, integrated into the turbine casing, that are thermally expanded and contracted to control radial positioning of the turbine shroud. Compressor air is directed through internal passages in the rings to cause the expansion and contraction. The system utilizes the pressure and temperature of compressor air, in combination with size, location, and structure of the control rings to match thermal growth of the control rings and turbine shroud to thermal growth of the turbine rotors, thereby controlling clearance.

9 Claims, 4 Drawing Figures

CLEARANCE CONTROL

BACKGROUND OF THE INVENTION

1. Field of the Invention

This invention relates to means for controlling clearance between rotating turbine parts and a surrounding shroud in a gas turbine engine.

2. Summary of the Prior Art

In an effort to maintain a high degree of efficiency, manufacturers of turbine engines have strived to maintain the closest possible clearance between rotating turbine parts and surrounding turbine shroud structure, because any gas which passes therebetween represents a loss of energy to the system. If a gas turbine were to operate only under steady-state conditions, it would be a relatively simple matter to establish the desired close clearance relationship between the rotating turbine parts and the turbine shroud. However, in reality, all turbine engines must initially be brought from a cold, standstill condition up to steady-state speed at relatively hot temperatures, and eventually return to the standstill condition. Operating conditions are even more complicated in turbine engines used to propel jet aircraft because the engines are frequently thrown into maximum acceleration or deceleration under both hot and cold engine temperature operation.

The problems in maintaining clearance between turbine blades and turbine shrouds under these conditions are caused by first, the mechanical expansion and shrinkage of the rotating turbine parts as brought about by changes in speed, and secondly, by relative thermal growth between rotating turbine blade tips and surrounding shrouds caused by differences in thermal inertia. One commonly used method of decreasing turbine tip clearance has been to properly select various materials with thermal properties that assist in matching radial growth responses at different engine operating conditions. Another method has been to actively direct and modulate variable temperature air on the outside of the turbine section of the engine. In this latter method, the air is directed on the turbine section during appropriate stages of engine operation to change the radial growth or shrinkage rate of the turbine shroud support in an effort to match the growth or shrinkage of the rotating turbine parts. These "active" clearance control systems generally require complex systems of pipes, valves, and controls to properly direct cooling air to the turbine section. The "active" system also requires significant amounts of compressor or fan air, much of which is underutilized because it is released outside the turbine section where it cannot be contained, thus causing a drain on engine performance.

It is, therefore, an object of the present invention to provide a gas turbine engine which allows decreases in clearance in a turbine section of the engine with a lesser drain on engine performance.

Another object of the invention is to control clearance between rotating turbine parts and surrounding shrouds during critical transient and steady-state phases of engine operation.

Another object of one embodiment of the present invention is to provide a turbine engine with a system that efficiently utilizes compressor air to decrease clearance between rotating turbine parts and a surrounding shroud during critical phases of engine operation.

These and other objects will become more readily apparent from reference to the following description taken in conjunction with the appended drawings.

SUMMARY OF THE INVENTION

In the present invention, a system is provided in a turbomachine for controlling clearance between rotating turbine parts and a surrounding turbine shroud. To accomplish this purpose, a plurality of control rings with internal passages are integrated into the turbine casing, and are expanded and contracted thermally with fluid flow through the internal passages during engine operation to control radial positioning of the turbine shroud. The expansion and contraction of the shroud is matched to the expansion and contraction of the rotating turbine parts to maintain close clearance when the engine is operated over the spectrum from full power to reduced power.

In one embodiment of the invention, the fluid used to cause expansion and contraction of the control rings is compressor discharge air that is taken from a region surrounding the combustor section of the engine. Conveniently, the temperature and pressure of this air closely matches what is desirable for this function. The system utilizes the amount and pressure of the compressor air, in combination with the size, location and structure of the control rings, to expand and contract the turbine shroud during appropriate periods of engine operation.

DESCRIPTION OF THE PREFERRED EMBODIMENTS

Figure 1:
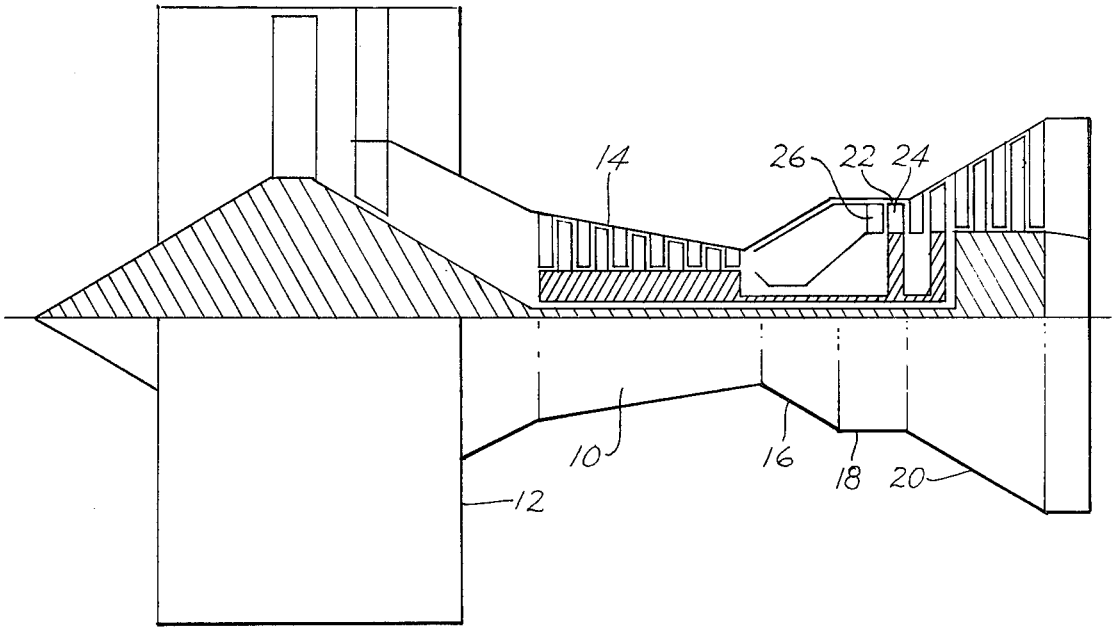
FIG. 1 is a diagrammatic representation of a gas turbine engine which is partly in section and partly broken away.

Referring now to the drawings, there is shown in FIG. 1 a gas turbine engine 10 comprising a fan section 12, compressor 14, combustor 16, high pressure turbine 18 and low pressure turbine 20, all in flow series. Inside the high pressure turbine 18, turbine parts are mounted for rotation within turbine shrouds 22. These rotating turbine parts, shown in FIG. 1, are known to those skilled in the art as a turbine rotor section, generally designated at 24. Certain major components of the high pressure turbine 18 do not rotate, and these are known as the turbine stator 26.

Figure 2:
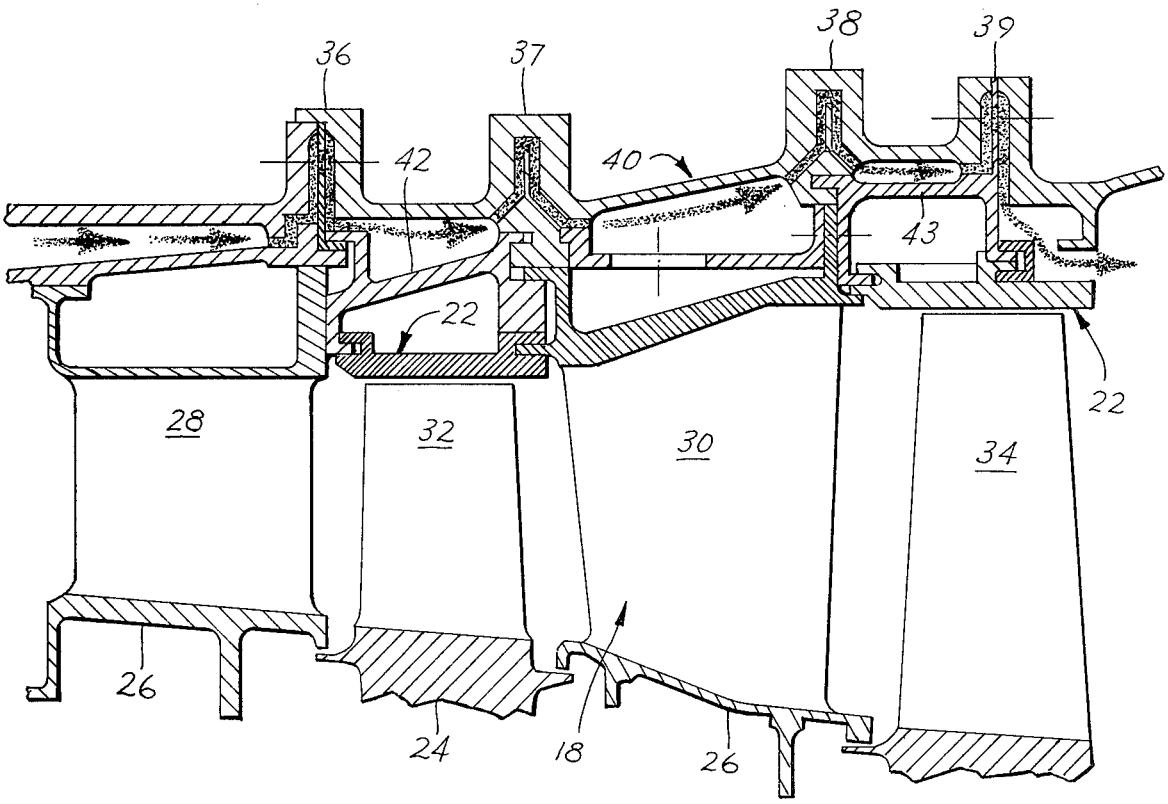
FIG. 2 is an enlarged sectional view of a high pressure turbine of a gas turbine engine incorporating one embodiment of the present invention.

Referring now to FIG. 2, the high pressure turbine 18 and associated structures are shown in greater detail with the present invention incorporated therein. The turbine stator section 26 comprises an inlet vane 28 and intermediate vane 30. The primary function of the vanes 28 and 30 is to properly direct the hot turbine gases against the blades 32 and 34 so that the inertial force of the gases causes turbine rotor section 24 to rotate. The efficiency of this transfer of inertial forces is a major factor in the overall efficiency of the engine. One means of improving the efficiency of this transfer is to decrease any flow of hot gases between tips of the turbine blades 32 and 34 and the surrounding turbine shroud 22. Any gases taking this path transfer very little inertial force to the blades. The volume of gases taking this undesirable flowpath is lessened by decreasing clearance between the turbine blade tips and the shrouds 22, and that is the purpose of the present invention.

The turbine tip clearance is decreased by radially expanding and contracting the turbine shrouds 22 to match the radial expansion and contraction of the tips of the turbine blades 32 and 34. Radial position of the shroud 22 is controlled by thermally expanding and contracting relatively massive ring structures 36, 37, 38, and 39 that extend radially outward from a turbine casing 40.

In the embodiment of the invention shown in FIG. 2, compressor discharge air is employed for the purpose of thermally expanding and contracting the rings 36, 37, 38 and 39. The compressor discharge air is derived from a region surrounding the combustor. In an alternate embodiment, interstage bleed air from upstream compressor stages could also be used to control all or selected rings. The path of the air through passages in the rings is generally shown by the dark arrows. The system utilizes the already available pressure of this compressor discharge air in combination with judiciously selected size, location and structure of the control rings and passages to properly control the thermal effect of the compressor air on the rings. The manner in which this is accomplished will be more fully described later in this description.

The radial movement of the control rings 36, 37, 38 and 39 is physically transferred to the turbine shroud 22 through shroud supports 42 and 43. Each shroud support physically interconnects with a portion of the shroud 22 in such a manner that an essentially box-like cross-sectional configuration is formed. Each of the rings 36, 37, 38 and 39 is carefully positioned radially outward of a radial side of this box-like configuration. This allows each ring to more directly affect expansion and contraction of a radial side of a shroud support, along with a corresponding portion of the shroud 22. The turbine shroud support components are either segmented or saw cut in design to avoid diverging from the radial position that the casing seeks as its ring temperature control function works. Thus, the box-like configuration in combination with the corresponding ring positioning permits very accurate control of the shroud position without causing the shroud portion to "tilt" and become unaligned with an adjacent blade tip. If a loss of alignment would occur, a portion of the turbine blade would "rub" against a portion of the shroud. Any "rubbing" of this nature would cause nonalignment of the turbine tips and corresponding turbine shroud and increase the turbine tip clearance during subsequent engine operation.

Operation

Initially, a gas turbine engine is started and operated at idle speed. During idle, the engine is not being called upon to deliver large amounts of power and engine efficiency is not critical. With this in mind, the turbine tip clearance can be set at a relatively high level. On the other hand, during high throttle and/or cruise operation, an engine must develop large amount of power over a long period of time. Under such conditions, efficiency is critical, and turbine tip clearance must be as low as is reasonably possible. Achieving a lower turbine tip clearance during cruise operation is accomplished by directing compressor discharge air that is cooler at cruise, through the control rings 36, 37, 38, and 39. Contraction of the rings occurs, and corresponding radial shrinkage of the turbine shroud 22 lessens turbine tip clearance and improves turbine efficiency.

This desirable effect during cruise operation is complicated by problems incurred during engine transients, such as acceleration and deceleration. During engine transients localized thermal effects of hot turbine gases and radial expansion caused by high rotational speed makes it particularly difficult to match radial growth of the turbine shroud with radial growth of the rapidly rotating turbine parts. While efficiency is relatively unimportant during these transients, it is essential for clearance that the shroud 22 does not physically interfere with the rotating turbine blades 32 and 34. Any interference would cause a "rub" that will remove or "rub off" a portion of the turbine blades 32, 34 and shrouds 22. When the engine is subsequently operated at cruise conditions, the turbine tip clearance would be increased because of the "rubbed off" portion of the blades and shrouds, resulting in a significant decrease in turbine efficiency.

Figure 3:
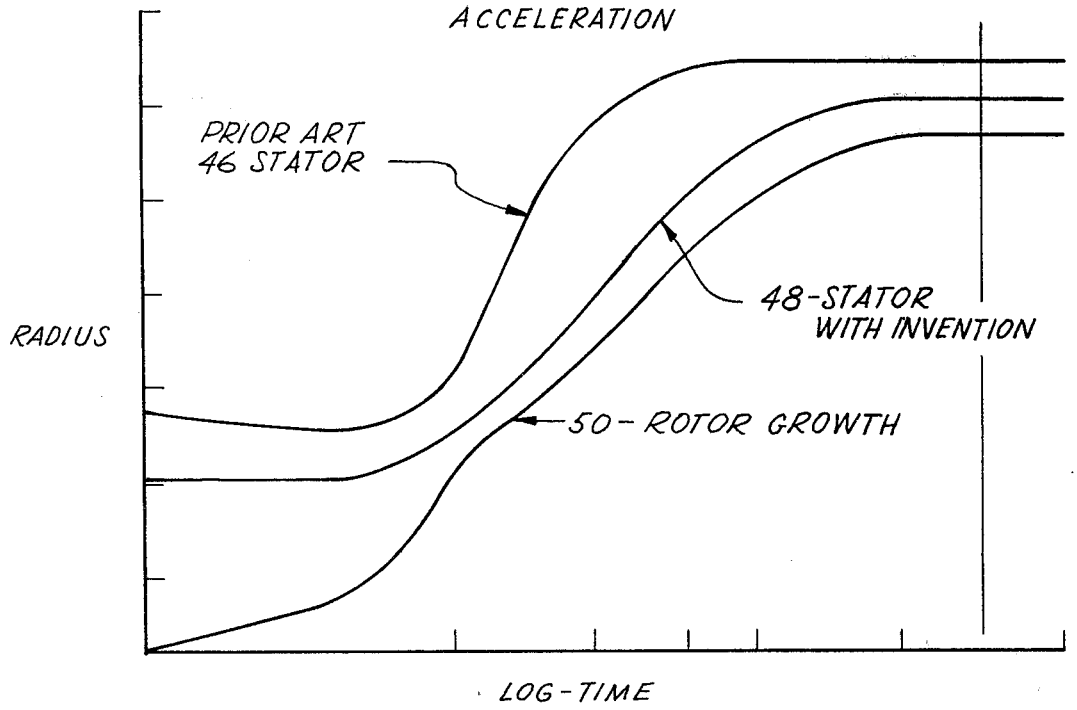
FIG. 3 is a graphic representation of turbine stator and rotor growth from engine idle to full throttle conditions.

To prevent "rubs" during engine transients, the present invention utilizes the phenomenon of relatively slow heating and cooling rates inherent to large, heavy ring structures located in cavities where the air circulation is weak. In the present invention, the rings 36, 37, 38 and 39, shown in FIG. 2, are located in a relatively weak air circulation region surrounding the turbine. By making the rings relatively massive, and by limiting any surrounding air circulation, heating and cooling rates of the turbine shroud during engine transients can be controlled. Specifically, by admitting small quantities of high pressure compressor discharge air from the region surrounding the combustor into the rings, and by circulating this air within the rings, the following desirable transient response characteristics will be achieved:

1. Engine Acceleration—When the engine is accelerated, the compressor air from the region surrounding the combustor is relatively hot because of the work done on it by compressing it and the heat transfer from the combustor 16. Circulation of this hot air through the rings 36, 37, 38 and 39 causes and controls thermal expansion that "moves" the turbine shroud 22 radially outward and away from the thermally expanding turbine. As embodied, there is very little effect, if any, during the early acceleration portion of the transient. This avoids a "rub" and any consequent damage to the turbine blades 32, 34 and shroud 22. FIG. 3 is a graphical depiction of calculated radial growth of turbine stator and rotor components during engine acceleration. The growth curve designated 46 represents stator growth in a prior art engine without the present invention. The curve designated 48 illustrates growth of a turbine stator with the present invention incorporated into the engine. The curve designated 50 represents turbine rotor growth in engines with or without the invention. The much closer match of growth rates in an engine incorporating the present invention is clearly evident in FIG. 3. This characteristic has significant advantages in that acceleration induced turbine inlet temperature "overshoot" is greatly reduced. This "overshoot" occurs when the control demands a specific engine power output when the clearances are relatively very large. Extra fuel is burned to produce the power at these inefficient clerance values. The extra fuel burned causes the high pressure turbine vanes and blades to run transiently at higher temperature levels than normal design values, which reduces component life. The present invention will significantly decrease this "overshoot."

2. Engine Deceleration —When the engine is decelerated from high to low power settings, the compressor discharge pressure drops off with engine speed to very low values. Consequently, the circulation strength of the air through the cooled rings 36, 37, 38 and 39 is reduced, and the cooling response rate of the rings is very slow, simply because the rings stay relatively hot in a low circulation environment, while the rest of the engine cools off. This delayed response pattern is very desirable because it keeps the turbine shroud 22 in a radially expanded position so that upon rapid reacceleration (reburst) the turbine blades 32 and 34 are less likely to incur a tip "rub" and damage the shroud 22.

Figure 4:
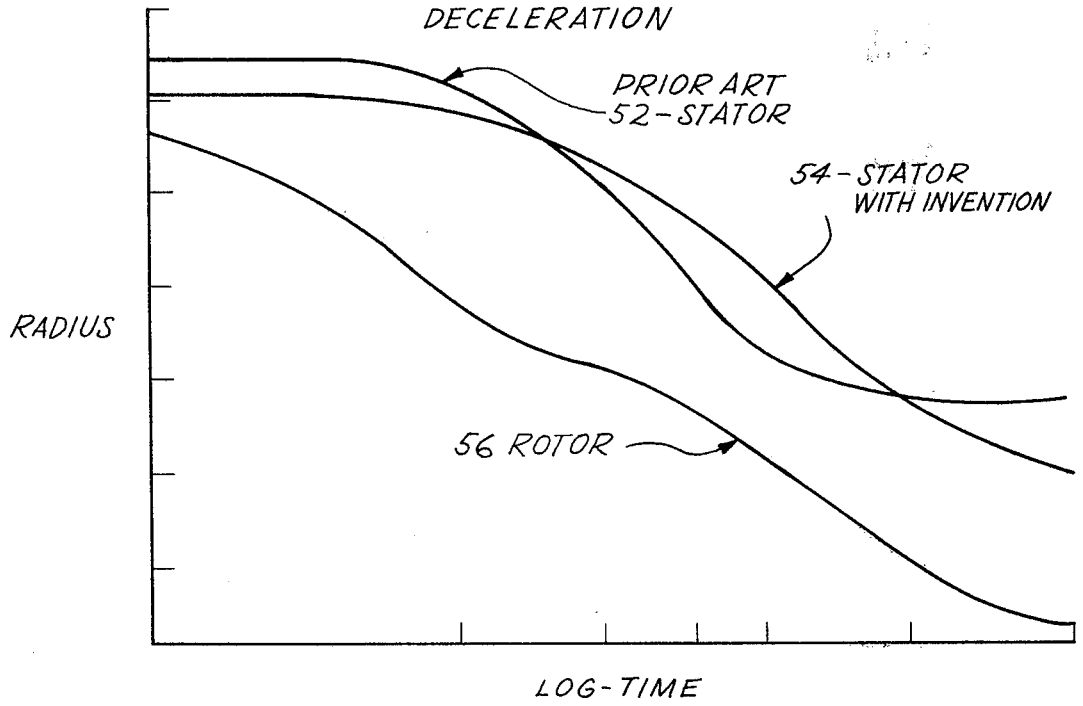
FIG. 4 is a graphic representation of turbine stator and rotor shrinkage from full throttle to engine idle conditions.

FIG. 4 is a graphical representation of calculated radial shrinkage of turbine rotor and stator components during engine deceleration. The shrinkage curve designated 52 depicts stator shrinkage in a prior art engine, and the curve designated 54 depicts stator shrinkage in an engine incorporating the present invention. The curve designated 56 depicts rotor shrinkage on an engine with or without the invention. It can be readily appreciated from the FIG. 4 that the shrinkage of a stator in an engine incorporating the present invention is significantly slower thereby retaining greater tip clearance so that the engine can be reaccelerated without incurring blade tip rub.

The above-described features of the present invention allow blade tip clearance to be set very closely. Transient response differences between the stator and rotor that have previously required either the setting of larger clearances or have caused increased engine deterioration rates need no longer be accounted for. Improved performance and reduced deterioration levels are made possible by the present invention. Through selection of ring materials and circulation air temperatures which match those of the rotor hardware, very little increase in clearance between acceleration and steady-state power settings will be experienced. Through judicious design of the turbine casing and rings geometry, cooling airflow levels, and materials selection, the turbine shroud growth can be made to approximate rotor growth. This makes it possible to set more constant and relatively low steady-state operating clearances while avoiding any blade tip rubs during transient operation. All of these features are achieved without the addition of any external or internal cooling manifolds, piping or control system sensor devices.

While specific embodiments have been described, it will be apparent to those skilled in the art that various modifications thereto can be made without departing from the scope of the invention, as recited in the appended claims. Therefore, the scope of the invention is to be derived from the following claims.

Having described the invention, what is claimed as novel and desired to be secured by Letters Patent of the United States is as follows:

1. An improved turbomachine having a compressor section and a turbine section with turbine parts rotating in close clearance relationship within a circumferential turbine shroud structure for operation over a range of temperatures and speeds, wherein the improvement comprises:

at least one pair of clearance control rings structurally integrated into a turbine case surrounding the turbine section, wherein said rings comprise radially extending structures that are provided with internal passages for directing a fluid through said pair of rings to control thermal growth thereof, said pair of rings being generally radially aligned with a turbine shroud, a first control ring of said pair being generally radially aligned with an upstream end of said turbine shroud with a second control ring of said pair being generally radially aligned with a downstream end of said turbine shroud; and means for causing thermal growth of said turbine shroud to respond to thermal growth of said pair of control rings for the purpose of controlling clearance between said turbine shroud and said rotating turbine parts wherein said generally aligned pair of control rings causes said turbine shroud to expand and contract radially and remain parallel to a central axis of said turbomachine.

2. The apparatus recited in claim 1, wherein means are provided to direct said fluid at varying temperature and pressure to cause ring temperature and corresponding radial growth to closely match rotor growth between various turbomachine steady-state operations.

3. The apparatus recited in claim 2 wherein:

said fluid is provided in greater amounts at relatively high pressure and high temperature relative to said turbine section during turbomachine acceleration, thereby causing said control rings to grow thermally and expand radially to prevent interference between said turbine shroud and rotating turbine parts undergoing rapid radial expansion;

said fluid is provided at appropriate temperature and pressure relative to said turbine section during turbomachine steady-state operation to cause said control rings to thermally react to lessen clearance between said rotating turbine parts and said turbine shroud; and said fluid is provided in lesser amounts at relatively low pressure during turbomachine deceleration thereby delaying any thermal shrinkage of the turbine shroud during deceleration and thereby increasing said clearance for the purpose of preventing interference between said turbine shroud and said rotating turbine parts upon subsequent turbomachine acceleration.

4. The apparatus recited in claim 2 wherein said fluid is compressor discharge air derived from a region surrounding a combustor section of said turbomachine.

5. The apparatus recited in claim 1 wherein one or more of said pairs of rings are aligned with a turbine shroud support that interconnects with said turbine shroud to form a structure that is box-like in cross section and supports said corresponding turbine shroud.

6. The apparatus recited in claim 1 wherein said internal passages include means for circulating air within each of said rings to control thermal growth thereof.

7. The apparatus recited in claim 6 wherein the turbine section includes at least two rows of turbine blades rotatably disposed within a respective row of said turbine shroud with each of said rows of turbine blades being provided with a separate pair of said clearance control rings.

8. In a method of clearance control for use in combination with a turbomachine having rotating parts surrounded by shroud structure which is coupled to a turbine case of the type having a plurality of radially extending structures each of which is provided with internal passages, comprising the step of:

circulating a fluid through said internal passages of said radially extending structures to control thermal growth of said radially extending and shroud structures.

9. A method in accordance with claim 8 in which said turbomachine includes a compressor section, a turbine section, a combustor section and said fluid comprises compressor discharge air derived from a region surrounding said combustor section of said turbomachine.

* * * * *